US005859577A

United States Patent [19]

Nihei et al.

[11] Patent Number: 5,859,577

[45] Date of Patent: Jan. 12, 1999

[54] TRANSFORMER WITH LAMINATED SHEET CORES

[75] Inventors: Takayuki Nihei, Chiba; Norio Sato, Yotsukaido, both of Japan

[73] Assignee: TDK Corporation, Tokyo, Japan

[21] Appl. No.: 838,810

[22] Filed: Apr. 10, 1997

[30] Foreign Application Priority Data

Apr. 17, 1996 [JP] Japan ..... 8-120979

[51] Int. Cl.[6] ..... H01F 27/02; H01F 27/26; H01F 27/30

[52] U.S. Cl. ..... 336/92; 336/192; 336/198; 336/210

[58] Field of Search ..... 336/210, 212, 336/198, 92, 90, 192

[56] References Cited

U.S. PATENT DOCUMENTS

| | | | |
|---|---|---|---|
| 4,075,590 | 2/1978 | Foldes | 336/210 |
| 5,034,854 | 7/1991 | Matsumura et al. | 336/92 |
| 5,264,815 | 11/1993 | Umeya et al. | 336/210 |

FOREIGN PATENT DOCUMENTS

| | | | |
|---|---|---|---|
| 144 981 | 11/1980 | Germany | 336/210 |
| 58-195405 | 12/1983 | Japan . | |
| 60-133712 | 7/1985 | Japan . | |
| 60-202916 | 10/1985 | Japan | 336/92 |
| 61-168617 | 10/1986 | Japan | 336/198 |
| 1-73909 | 5/1989 | Japan . | |
| 7-22050 | 3/1995 | Japan . | |

OTHER PUBLICATIONS

IBM Technical Disclosure Bulletin, "High Voltage Shield," Chacon et al, vol. 23, No. 1, Jun. 1980, pp. 65, 66.

*Primary Examiner*—Thomas J. Kozma
*Attorney, Agent, or Firm*—Oblon, Spivak, McClelland, Maier & Neustadt, P.C.

[57] ABSTRACT

A transformer with laminated sheet cores consists of a coil bobbin having a core hole, and a plurality of laminated sheet cores, each having a middle leg inserted into the core hole and a fixing member such as a cover fixed to the coil bobbin, receiving the ends of the sheet cores so as to prevent the sheet cores from being removed from the cover. The laminated sheet cores are fixed to the core bobbin without being pressed in the direction of their total thickness and without lowering the core characteristic. The transformer has a smaller number of the cores and can be manufactured at smaller processes.

2 Claims, 5 Drawing Sheets

TRANSFORMER WITH LAMINATED SHEET CORES

BACKGROUND OF THE INVENTION

1. Field of the Invention

The present invention relates to a transformer with laminated sheet cores, and more particularly to a transformer for communication in which the sheet cores require a high $\mu$ value.

2. Description of the Related Art

In general, a transformer with laminated sheet cores consists of laminated cores, a coil bobbin and a coil whose whole portions except for terminal portions are connected together by means of varnish or the like. Several laminated core fixing structures other than such a resin fixing structure are disclosed in the following documents:

First, Japanese Laid-open Utility Model Application Publication No. 1-73909 discloses a fixing structure for securing laminated cores to a coil bobbin by tightly inserting, into the core hole of the coil bobbin, both the laminated cores and a holding plate having side walls for preventing the removal of the laminated cores.

Secondly, Japanese Laid-open Utility Model Application Publication No. 58-195405 discloses a structure in which a sheet core intentionally bent is disposed at the outermost end of the core hole of a bobbin. In this arrangement, the bent sheet core is resiliently pressed against the inner wall of the core hole of the bobbin. Thus, the cores are fixed to the coil bobbin.

Thirdly, Japanese Laid-open Patent Application Publication No. 60-133712 discloses a structure in which a semi-cured type resin sheet is wound around the leg portions of laminated sheet cores so as to follow their contour and a thermal shrinkage tape of fabric having a high strength is wound around the semi-cured type resin sheet so as to uniformly wrap the sheet, and then the thermal shrinkage tape is thermally cured. In this way, the cores are fixed to a coil bobbin.

Since the above mentioned prior art discloses the technique of fixing laminated cores to a core bobbin by pressing the laminated cores in the direction of their thickness, there may occur problems in that $\mu$ of Permalloy, in particular, is lowered and magnetic distortion increases because the seat cores are pressed. In order to compensate deterioration of characteristic, the number of laminated core sheets must be increased. This enhances the cost of material and the machining cost.

SUMMARY OF THE INVENTION

The present invention was made under these circumstances and an object thereof is to provide a transformer in which laminated cores can be fixed to a core bobbin without lowering their characteristic whereby the transformer having a small number of cores can be manufactured at a low cost.

Another object of the present invention is to provide a transformer which can be assembled easily at small assembling processes.

A further object of the present invention is to provide a transformer which has a small size.

In order to achieve the objects, a transformer with laminated cores according to the present invention comprises a coil bobbin having a core hole; a plurality of laminated sheet cores of an E type, each having ends and a middle leg inserted into the core hole; a fixing member for receiving the ends of each of the sheet cores and preventing the sheet cores from being removed from the core hole, the fixing member being secured to the coil bobbin without pressing the laminated sheet cores in the direction of their total thickness.

The positions of the laminated sheet cores in the directions of the total thickness and the width of the laminated sheet cores can be controlled by making the cross-sectional dimension of the middle legs of the laminated sheet cores the same as the dimension of the core hole of the coil bobbin. The ends of the laminated sheet cores are received by the fixing member, and thus the laminated cores are prevented from being removed from the core hole so as to be fixed to the coil bobbin.

The transformer according to the present invention has a structure in which the fixing member comprises a cover having engaging pawls which engage receiving portions formed in the terminal fixing portions of the coil bobbin to secure the cover to the coil bobbin.

The transformer according to the present invention has another structure in which the fixing member comprises a cover having engaging pawls which are directed outward of the cover and engage receiving portions formed in the inner walls of the terminal fixing portions of the coil bobbin, thereby securing the cover to the coil bobbin.

DETAILED DESCRIPTION OF THE PREFERRED EMBODIMENT

Figure 1A:
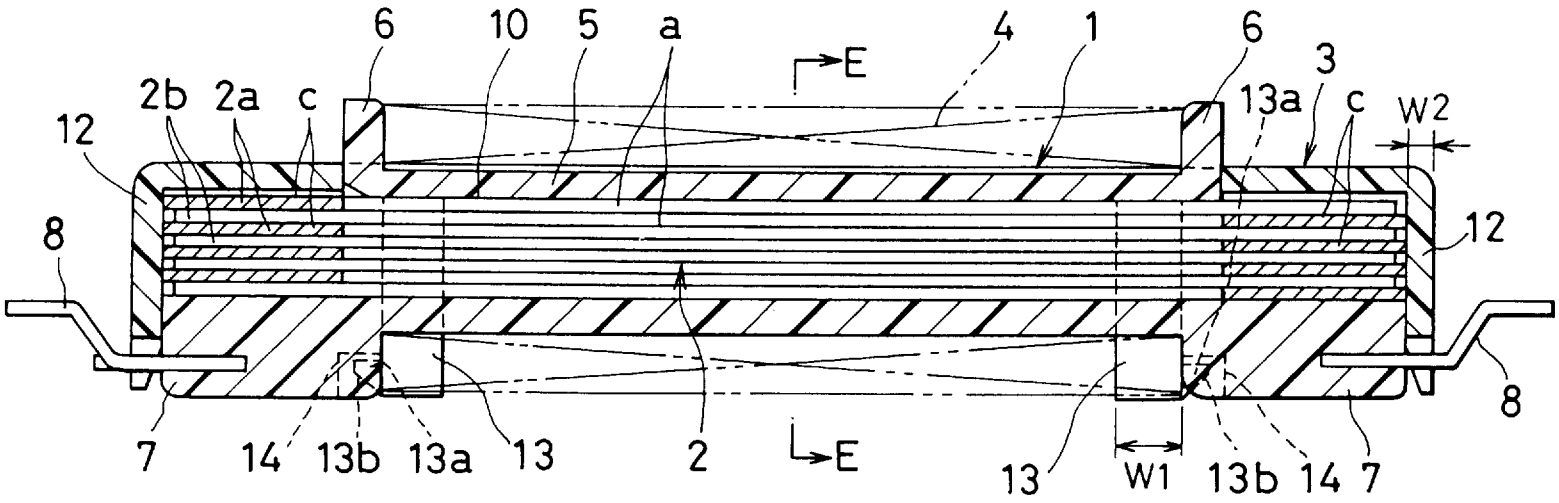
FIG. 1A is a cross-sectional view of an embodiment of a transformer according to present invention.
Figure 1B:
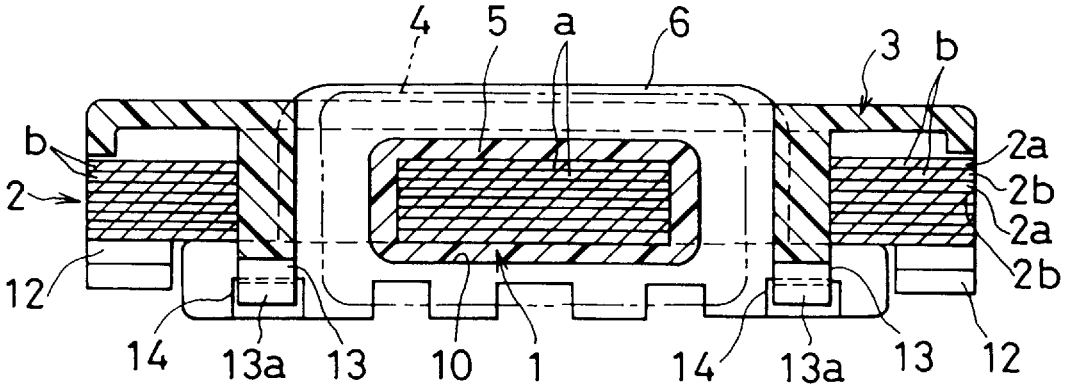
FIG. 1 is a cross-sectional view taken along line E—E of FIG. 1A.
Figure 4:
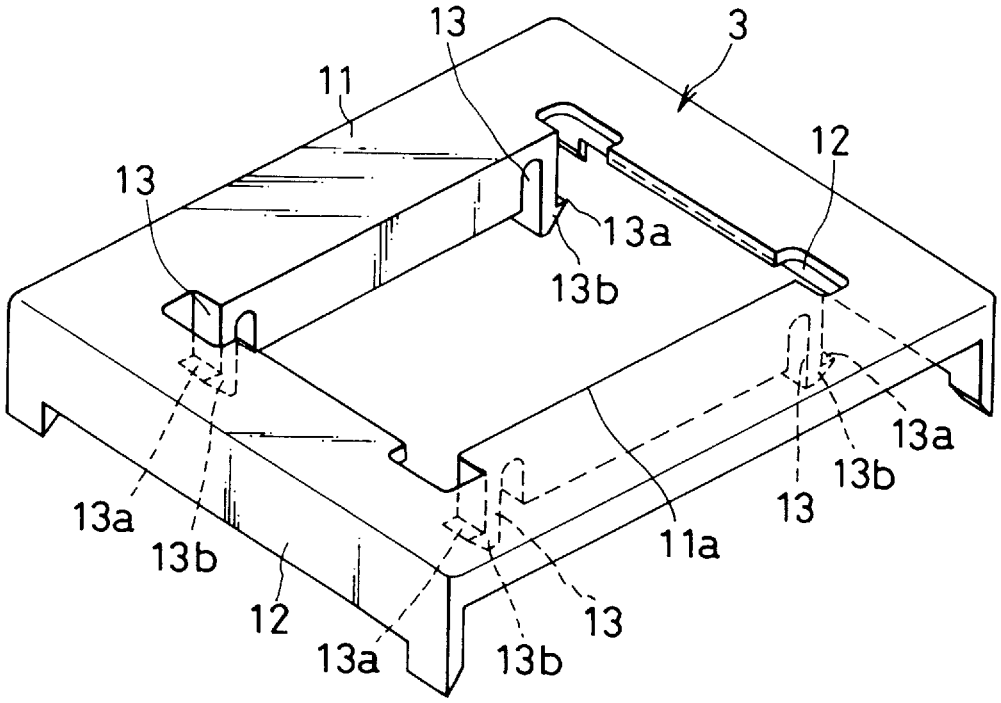
FIG. 4 is a perspective view of a cover of the embodiment of the present invention.

As shown in FIGS. 1A and 1B, an embodiment of a transformer comprises a coil bobbin 1 made of synthetic resin, laminated sheet cores 2 formed by E type sheet cores 2*a* and 2*b* made of a plate material having a high permeability such as Permalloy, silicon steel or magnetic amorphous metal, a cover 3 made of synthetic resin and functioning as a fixing member of the laminated sheet cores 2 and a coil 4 wound around the coil bobbin 1.

Referring to FIGS. 2 and 3A to 3C, the coil bobbin 1 has a winding drum 5 around which the coil 4 is wound. On both ends of the winding drum 5 are integrally formed flanges 6 and terminal fixing portions 7. On the terminal fixing portion 7 of each end of the winding drum 5 are provided external connection terminals 8 and coil end holding terminals 9. The number and the arrangement of both terminals are decided according to the kinds of the transformers which are to be used. Each external connection terminal 8 and the corresponding coil end holding terminal 9 are integrally connected together in the corresponding terminal fixing portion 7.

Figure 2:
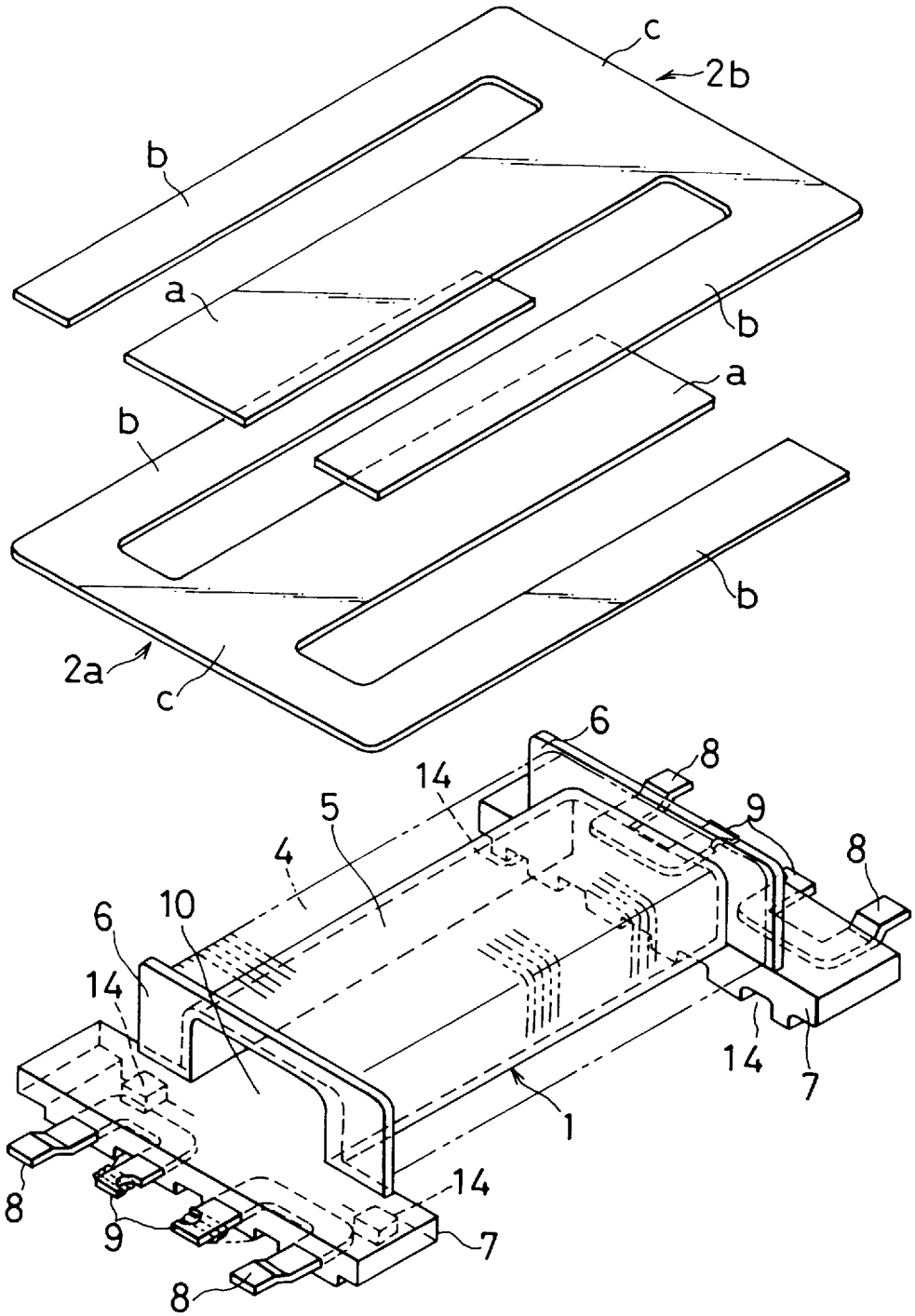
FIG. 2 is a perspective view of E type sheet cores and a coil bobbin of the embodiment of the present invention.

As shown in FIG. 2, the E type sheet cores 2*a* and 2*b* have the same shape. As shown in FIG. 1A, the sheet cores 2*a* and 2*b* are directed reverse to each other and their middle legs a are inserted alternately into the core hole 10 from both ends thereof in such a way that the cores 2*a* and 2*b* are laminated on each other in the core hole 10. Each sheet core 2*a* (2*b* ) has outer legs b and a root portion c as well as the middle leg a.

As shown in FIGS. 4 and 5A to 5C, the cover 3 has a top plate portion 11 and core receiving portions 12 which abut against the ends of the laminated sheet cores 2. A rectangular opening 11*a* is formed in the top plate portion 11 so that heat is radiated effectively therefrom. On each of the corners of the opening 11*a* of the cover 3 is integrally formed a downward extending engaging piece 13.

Figure 3A:
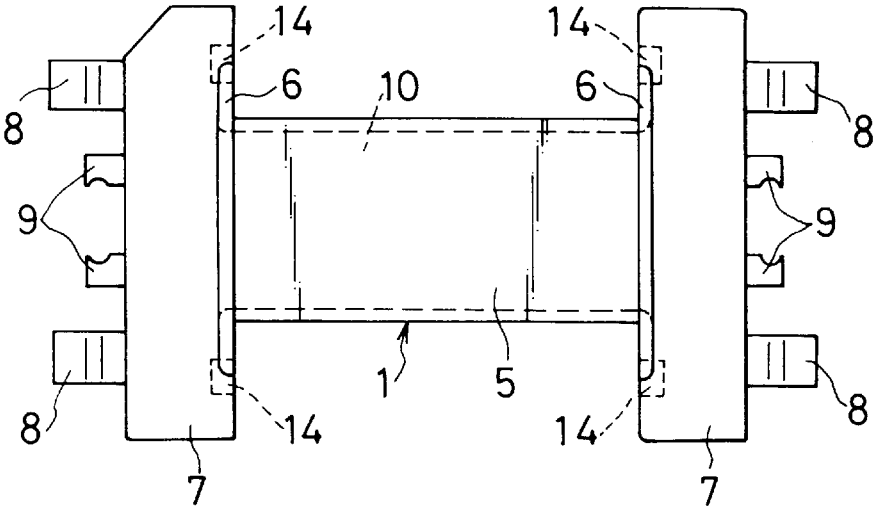
FIG. 3A is a plan view of the coil bobbin of the embodiment of the present invention.
Figure 3B:
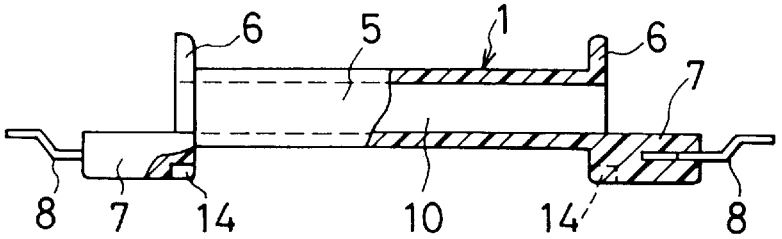
FIG. 3B is a partially broken side view of the coil bobbin of the embodiment of the present invention.
Figure 3C:
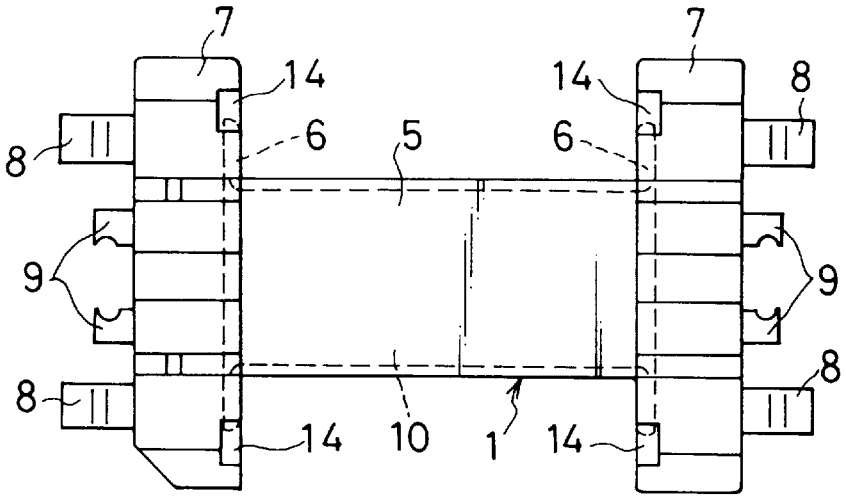
FIG. 3C is a bottom view of the embodiment of the coil bobbin of the present invention.
Figure 5A:
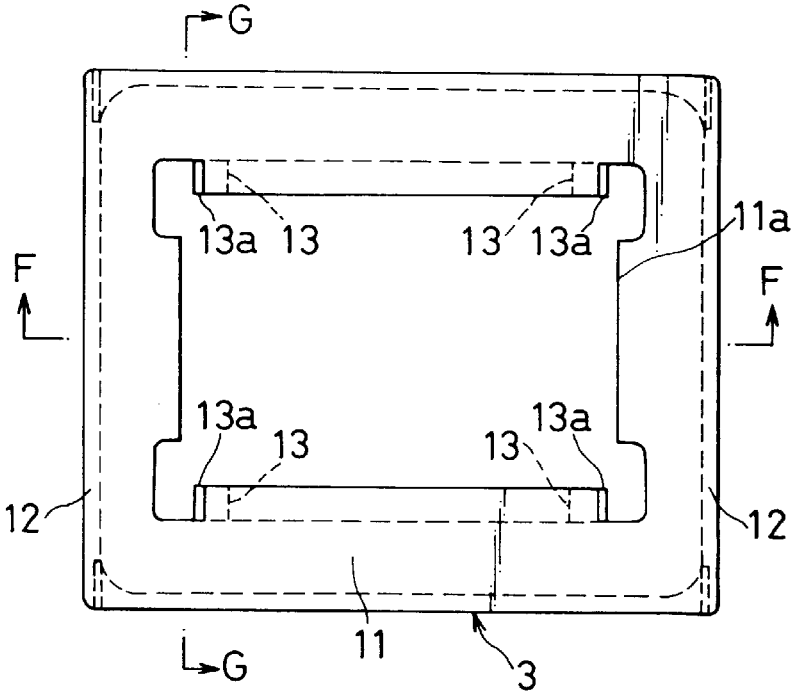
FIG. 5 is a plan view of the cover of the embodiment of the present invention.
FIG. 5B is a cross-sectional view of the cover taken along line F—F of FIG. 5A.
FIG. 5C is a cross-sectional view of the cover taken along line G—G of FIG. 5A.
Figure 5B:
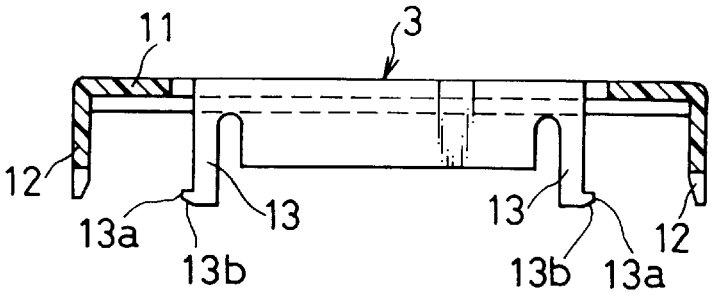
Figure 5C:
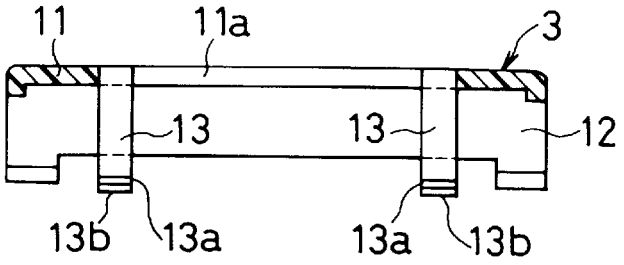

On the tip end of the engaging piece 13 is formed an outwardly extending engaging pawl 13*a*. The undersurface of the engaging pawl 13*a* forms an inclining surface 13*b* which acts as a guide face when the cover 3 is mounted on the coil bobbin 1. As shown in FIGS. 3B and 3C receiving portions 14 for engageably receiving the engaging pawls 13*a* are formed in the inner wall (the wall at the side of the winding drum) of each terminal fixing portion 7.

The E type sheet cores 2*a* and 2*b* are laminated by being inserted alternately into the core hole 10 of the coil bobbin 1 around which the coil 4 is wound. The cover 3 is pushed downward in a state in which the opening 11*a* of the cover 3 is fitted on the coil 4 and the flanges 6. The inclining surface 13*a* of each engaging piece 13 abuts against the inner wall of the corresponding terminal fixing portion 7 and the engaging piece 13 is elastically deformed. When each engaging pawls 13 abut against the corresponding receiving portion 14 of the terminal fixing portion 7, the engaging piece 13 is elastically restored to the original state, and each engaging pawl 13*b* engages the corresponding receiving portion 14. Thus, the cover 3 is fixed to the coil bobbin 1. As shown in FIG. 1A, when the cover 3 is fixed to the coil bobbin 1, the ends of the E type sheet cores 2*a* and 2*b* engage the core receiving portion 14, and the cores 2*a* and 2*b* are not removed from the core hole 10. In this way, the laminated sheet cores 2 are fixed to the coil bobbin 1.

The laminated sheet cores 2 are inserted into the core hole 10 and the positions in the directions of their total thickness and their width are limited. Since no force is exerted on the laminated sheet cores 2 in the direction of their total thickness (i.e., in the direction in which the cores are laminated), $\mu$ is not lowered and magnetic distortion is not produced. Because the laminated sheet cores 2 are prevented from being removed from the cover 3 and the middle legs a of the cores are inserted into the core hole 10, the movements of the laminated sheet cores 2 in all directions are limited and the cores 2 are secured to the coil bobbin 1. When the laminated cores made of Permalloy are used, the conventional transformer requires fourteen laminated cores, but the present invention requires only ten laminated cores 2 in order to obtain a required characteristic. Further, the attachment of the cover 3 to the coil bobbin 1 and the fixing of the laminated sheet cores 2 to the coil bobbin 1 can be performed simultaneously. Thus, the assembling processes of the transformer are reduced and the transformer can be easily assembled.

In the present invention, the engaging pieces 13 can be formed on the portions which corresponding to the outer walls of the terminal fixing portions 7. Since, however, each engaging piece 13 is required to have a predetermined thickness W1 (see FIG. 1A), it is preferred that the engaging piece 13 be formed on the inner wall of the cover 3 in such a way that the engaging pawl 13*a* is directed outward. When the engaging pieces 13*a* are formed to be directed outward, the projected length W2 of the core receiving portions 12 of the cover 3 from the end faces c of the corresponding terminal/fixing portions 7 can be reduced. As a result, the cover 3 can be made small.

In the present invention, fixing members may be attached to the terminal fixing portions 7 on both ends of the coil bobbin 1 in order to fix the laminated sheet cores 2 to the coin bobbin 1. The fixing member may not be of the type directly secured to the coil bobbin 1 but may be of the type indirectly fixed to the coil bobbin 1 by means of another member. Further, still another member for preventing the laminated sheet cores 2 from being removed from the coil bobbin 1 may be provided between the fixing member and the laminated sheet cores 2.

What is claimed is:

1. A transformer with laminated sheet cores comprising:

a coil bobbin having a core hole;

a plurality of laminated sheet cores of an E type, each having ends and a middle leg inserted into said core hole;

fixing means for receiving said ends of each of said sheet cores and preventing said each of said sheet cores from being removed from said core hole, said fixing means being secured to said coil bobbin without pressing said laminating sheet cores in a direction in which said sheet cores are laminated;

wherein said coil bobbin has terminal fixing portions with inner walls and receiving portions formed in said inner walls of said terminal fixing portions, and said fixing means comprises a cover having an opening formed in a top plate portion of said cover and engaging pawls which are formed on each corner of said opening and are directed outward of said cover and engage said receiving portions to secure said cover to said coil bobbin.

2. The transformer with laminated sheet cores according to claim 1, wherein said terminal fixing portions include terminals protruding outwardly.

* * * * *